United States Patent [19]

Ferron

[11] Patent Number: 4,515,061

[45] Date of Patent: May 7, 1985

[54] TRUMPET WITH IMPROVED TONE

[75] Inventor: Ernest Ferron, Rouen, France

[73] Assignee: Establissement E. Ferron, France

[21] Appl. No.: 451,738

[22] Filed: Dec. 21, 1982

[30] Foreign Application Priority Data

Dec. 22, 1981 [FR] France ..... 81 23961

[51] Int. Cl.[3] ..... G10D 7/10

[52] U.S. Cl. ..... 84/394

[58] Field of Search ..... 84/387 R, 388, 393, 84/394

[56] References Cited

U.S. PATENT DOCUMENTS

| | | | |
|---|---|---|---|
| 52,580 | 2/1866 | Lehnert | 84/387 |
| 856,642 | 6/1907 | Jay | 84/394 |
| 1,073,593 | 9/1913 | Couturier | 84/394 |
| 2,987,950 | 6/1961 | Kent . | |
| 3,507,181 | 4/1970 | Cardwell, Jr. . | |
| 4,273,020 | 6/1981 | Happe | 84/394 |

*Primary Examiner*—Lawrence R. Franklin

*Attorney, Agent, or Firm*—Brumbaugh, Graves, Donohue & Raymond

[57] ABSTRACT

Trumpet with linear or rotary pistons, such as B-flat, C, D or E-flat trumpets, wherein the bottom of the tuning bow comprises a conical widening and the lower tube of the tuning slide assembly slides outside the tube integral with the set of pistons, which integral tube is shortened with respect to the upstream end of the lower tube of the slide assembly in the abutting position, the remaining part of the bore being substantially cylindrical and of same diameter. When dividing the tuning bow into six sections of equal axial length, the conical widening starts in the fifth section and the upstream end of the tube integral with the set of pistons is situated just beyond a seventh section having the same axial length as the others.

15 Claims, 4 Drawing Figures

TRUMPET WITH IMPROVED TONE

BACKGROUND OF THE INVENTION

The invention relates to trumpets for orchestras with linear or rotary pistons.

The problem of the tone of these instruments has been for a long time, a constant subject of researches and reference can be made on this point to the work "Musical Acoustics: Piano and Wind Instruments" by Earle L. KENT, published in 1977 by DOWDEN; HUTCHINSON & ROSS, INC., Stroudsburg, Pa., U.S.A. and also to U.S. Pat. Nos. 3,507,181 and 2,987,950.

More particularly, it was noted that all the conventionally-built trumpets, such as the B-flat, the C, the D, or the E-flat trumpets, all have the same characteristic fault of having a group of three notes which are too low-pitched (the D5, the D-sharp 5, the E5 for the C trumpet) which is a great source of complaint from trumpet players.

This fault being general, some players have maintained that these notes are "wrong notes by nature", whereas others, like KENT in his U.S. Pat. No. 2,987,950, propose relatively complicated palliatives.

SUMMARY OF THE INVENTION

The object of the invention is to propose a trumpet, namely a B-flat, a C, a D or an E-flat trumpet, without the aforesaid fault, whilst on the whole preserving, the characteristics of a conventional trumpet.

This object is reached due to the fact that the bottom of the tuning slide bow of the trumpet comprises a conical widening portion and that the lower tube of the tuning slide assembly slides outside of the tube integral with the set of pistons, instead of sliding inside, as has been the case up to now. Moreover, the tube integral with the set of pistons is shortened with respect to its conventional length, meaning that it is shortened with respect to the upstream end of the lower tube of the tuning side assembly, in an abutting position.

In addition to the conical widening according to the invention and the upstream end of the lower tube of the tuning slide assembly, except for the conical widening the bore is substantially cylindrical and has the same diameter from the upper tube of the tuning slide assembly to where the bell bow starts.

It is assumed that the effect of the modification proposed according to the invention can be explained as follows. It is known, when designing the acoustics of a wind instrument, that to increase the diameter of a tube on a speed loop is equivalent to modifying the impedance of the tube at that wavelength and the frequency rises.

On the contrary, the pitch of the note goes down if the diameter is increased on a pressure loop.

The calculations made by the inventor on the effective wavelengths inside a C-trumpet (the results are immediately transposable with C-flat, D- or E-flat trumpets) give the presence of speed loops for the notes E-4, D-flat and D-4 at the bottom of the bow of the tuning slide assembly, which are at intervals of about 16 mm from the hole of the water-key (if any) towards the pistons.

At this point, in conventional assemblies, the lower tube integral with the tuning slide bow slides inside the lower tube integral with the set of pistons.

According to the invention, the lower tube of the tuning slide assembly slides outside the tube integral with the set of pistons.

This novel design makes it possible to widen the bore at the level of special speed loops of notes whose pitch is to be raised, and has an astonishing and positive effect on the right tone curve of the instrument; indeed, whereas the said widening might have been feared to be beneficial only for the notes to be raised and detrimental to the pitch of other notes whose speed or pressure loops are also situated in the corrected zone, it has proved that many other slightly wrong notes in a conventional instrument are returned to their correct value.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
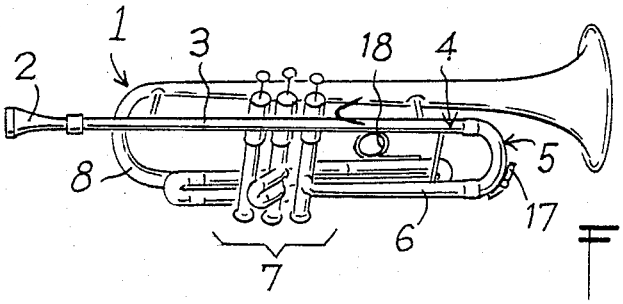
FIG. 1 PRIOR ART
FIG. 1 is a perspective view of a conventional trumpet.

The conventional trumpet 1 shown in FIG. 1 comprises in succession the mouthpiece 2, the leadpipe 3 which conically widens to where the bore starts. Said bore remains cylindrical all along the tuning slide assembly 5, from the tube 6 integral with the set of pistons 7 to where the bow of the bell starts (8).

Figure 2:
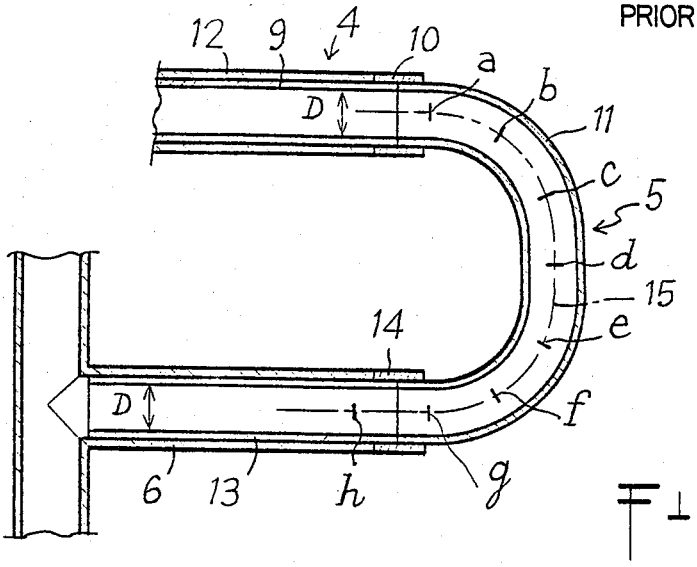
FIG. 2 PRIOR ART
FIG. 2 is a cross-sectional view of the tuning slide bow of a conventional trumpet.
Figure 3:
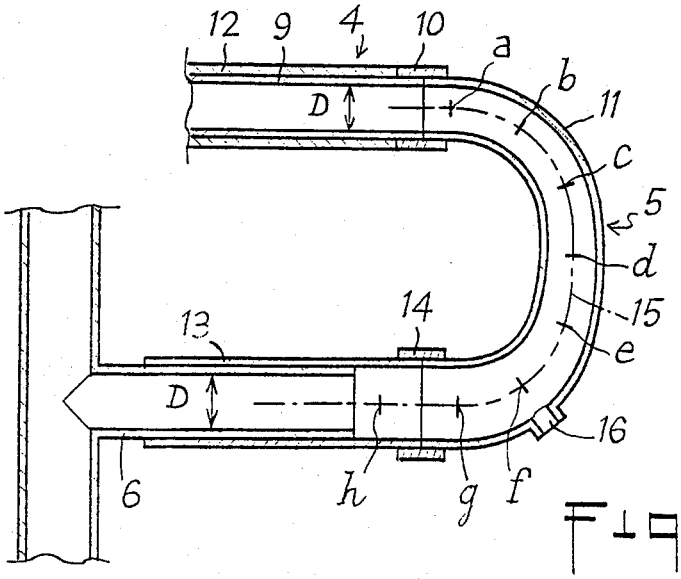
FIG. 3 is a cross-sectional view of the tuning slide bow of a trumpet according to the invention.

FIGS. 2 and 3 give a comparison of the tuning slide assemblies 5 of a conventional C-trumpet (FIG. 2) and of one according to the invention (FIG. 3). Obviously, what is said for the C-trumpet is transposable to trumpets of other tones.

In the conventional assembly, the upper tube 9 of the tuning slide assembly 5, connected by way of a ferrule 10 to the U-shaped tuning slide bow 11 (i.e., a 180° bend or bight) slides inside the tube 12 ending the leadpipe 3, and the lower tube 13 of the tuning slide assembly 5, connected by a ferrule 14 to the tuning slide bow, slides inside the tube 6 integral with the set of pistons.

The wavelengths calculations show that, if the bow 11 is divided into six equal intervals (ab, bc, cd, de, ef, fg) counted over the central axis 15 of the bow, from upstream to downstream, starting from division a which corresponds to where the curve of the bow starts, up to division g which corresponds to the end of the curve of the bow, the speed loops of the E-4 and of the D-flat are substantially inside the cross-sections corresponding to division f and g. The loop of the D-4 is situated inside a cross-section corresponding to an additional division h, with the same interval as the others, and situated beyond the tuning bow. Division f (the loop of the E-4) generally falls on the hole 16 of the water key 17, if there is one (the water key is shown in FIG. 1, the hole of the water key being shown only in FIG. 3). The bore, whose nominal diameter D is defined in 4, is cylindrical and uniform right along the tuning slide assembly.

According to the invention, the bore at the bottom bottom of the bow 11 is conically widened so as to enclose the speed loops situated in f, g and h. The conical widening therefore starts from the fifth section or interval ef up to the end g of the curved portion of the bow, which is connected via the ferrule 14 to the lower tube 13 of the tuning slide assembly 5, which latter then slides outside the tube 6 integral with the set of pistons, whose inner diameter is taken to be equal to the nominal diameter D of the bore, still defined in 4.

To ensure that the diameter of the pipe is increased where the speed loop is situated in h (for the D4), the right end of the integral tube 6 is shortened with respect to the upstream end of the lower tube 13 of the slide assembly in abutting position (position of FIGS. 2 or 3). In other words, the conical widening of the bore starts about in the middle of the interval ef, continues up to g, after what the bore remains cylindrical over the interval gh and over about half the next interval (not shown), before resuming the nominal diameter D. Since the conical widening starts about in the middle of the interval ef, the conical widening occurs over about the last $\frac{1}{4}$ of the curved portion of the tuning slide bow 11. Of course, the conical widening may occur over a smaller or larger portion of the tuning slide bow 11.

On a C-trumpet, the intervals between the divisions are about 16 mm. Therefore, for a C-trumpet, which is also provided with a hole 16 of water key 17, it is noted that the conical widening starts about 8 mm above the hole 16 and that the right end tube 6 integral with the set of pistons is about 10 mm away from the left end of the curved portion of tuning slide bow 11.

Figure 4:
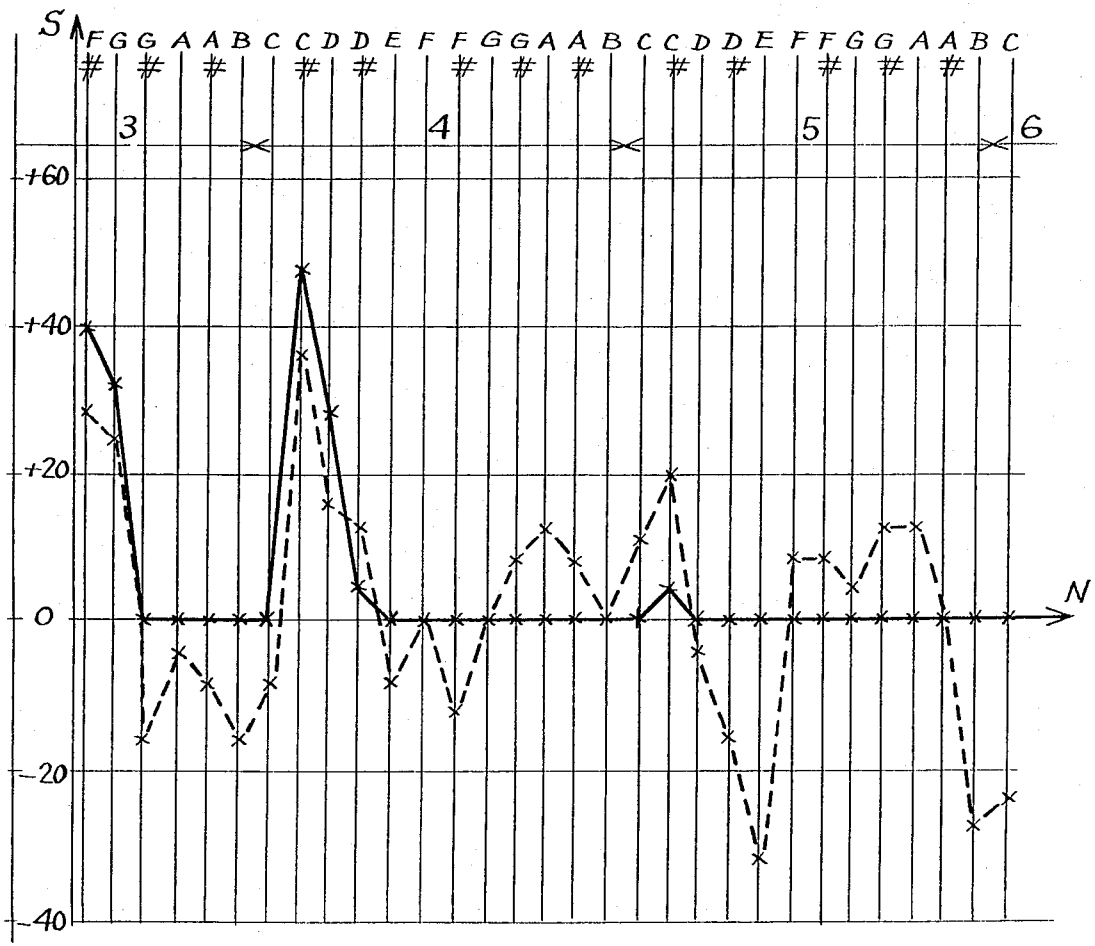
FIG. 4 shows on the same graph, the respective tone curves of a conventional C-trumpet and of a C-trumpet according to the invention.

FIG. 4 is a graph showing in abscissae, the notes N; in ordinate is given the deviation S with respect to the right-pitch note (pitch-tuned at A=442 Hz), the said deviation being expressed in Cents (i.e. in one hundredths of semitone).

The dotted line is marked for a conventional trumpet. A number of wrong-pitch notes are noted thereon, and in particular the notes D-5, D-flat 5 and E-5 which are too low.

The block line shows the correct tone curve for the same trumpet after modification according to the invention. It will be noted that not only the three notes D-5, D-flat 5, and E-5 are back on diapason, but other notes also, which were before either too low-pitched or too high-pitched, are re-set on the right frequency. On this graph, drawn purposely without any tuning from the musician, the notes F-flat 3, G-3, C-flat 4 and D-4 remain too high-pitched, but they are rectified during normal playing by the movable slides of the first and third pistons which slides are conventionally provided ith finger rings (such as 18 in FIG. 1), or key systems provided to this effect and the use of which forms part of the normal playing of the instrument.

The invention therefore permits to overcome a general defect of construction in trumpets.

What is claimed is:

1. In a trumpet comprising, and connected in succession, a mouth piece, a lead pipe, a tuning slide assembly, a piston tube, a set of pistons, a bell tube and a bell, said tuning slide assembly in turn comprising an upper tube, a tuning slide bow having a curved portion, and a lower tube, the improvement wherein the inner bore defined by the tuning bow comprises a conical widening portion along only a portion of said curved portion.

2. The trumpet as claimed in claim 1 wherein the conical widening portion is located at the end of the curved portion adjacent the lower tube.

3. In a trumpet comprising, and connected in succession, a mouth piece, a lead pipe, a tuning slide assembly, a piston tube, a set of pistons, a bell tube and a bell, said tuning slide assembly in turn comprising an upper tube, a tuning slide bow having a curved portion, and a lower tube, the improvement wherein the bores defined by the upper tube and piston tube have substantially equal diameters, wherein the bore defined by the curved portion has a conical widening along only a portion thereof, wherein the bore defined by the lower tube has a diameter substantially equal to the outside diameter of the piston tube, and wherein the end of the piston tube is received inside the lower tube.

4. The trumpet as claimed in claim 3 wherein the end of the piston tube is displaced from the end of the curved portion a distance of about one-fourth of the axial length of the curved portion.

5. In a trumpet comprising, and connected in succession, a mouth piece, a lead pipe, a tuning slide assembly, a piston tube, a set of pistons, a bell tube and a bell, said tuning slide assembly in turn comprising an upper tube, a tuning slide bow having a curved portion and a lower tube, the improvement wherein the inner bore defined by the tuning bow comprises a conical widening adjacent to the lower tube, wherein said piston tube has a cross section smaller than, and is received inside, the lower tube of said tuning slide assembly, wherein the end of the piston tube received therein is displaced from the end of the curved portion, and wherein the bores defined by the upper tube and piston tube have substantially the same diameter.

6. The trumpet as claimed in claim 5, wherein the length of the conical widening of the tuning bow is about one-fourth the length of its curved portion, and wherein the end of the piston tube is displaced from the end of the curved portion a distance corresponding to about one-fourth of the axial length of the curved portion.

7. The trumpet as claimed in claim 5 wherein the curved portion of the tuning slide bow comprises a 180° bend.

8. The trumpet as claimed in claim 5 wherein the length of the curved portion of the tuning slide bow is about 96 mm and wherein the length of the conical widening portion is about 24 mm.

9. The trumpet as claimed in claim 5, including a water key located on the conical widening portion at a point displaced from the beginning of the conical widening portion.

10. The trumpet as claimed in claim 9 wherein the water key is located about 8 mm from the beginning of the conical widening portion.

11. A C-trumpet having a tuning slide assembly comprising, and connected in succession, an upper tube, a tuning slide bow having a curved portion, and a lower tube, wherein the inner bore defined by the curved portion has a conical widening portion adjacent to the lower tube, and wherein a water key is provided on said curved portion at a point displaced from the beginning of the conical widening portion.

12. The trumpet as claimed in claim 11 wherein the water key is located about 8 mm from the beginning of the conical widening portion.

13. The trumpet as claimed in claim 11 wherein the curved portion of the tuning slide bow comprises a 180° bend.

14. The trumpet as claimed in claim 11 wherein the conical widening portion of the tuning bow is about one-fourth the length of its curved portion, and wherein the end of the piston tube is displaced from the end of the curved portion a distance corresponding to about one-fourth of the axial length of the curved portion.

15. The trumpet as claimed in claim 11 wherein the length of the curved portion of the tuning slide bow is about 96 mm and wherein the length of the conical widening portion is about 24 mm.

* * * * *

UNITED STATES PATENT AND TRADEMARK OFFICE

CERTIFICATE OF CORRECTION

PATENT NO. : 4,515,061

DATED : May 7, 1985

INVENTOR(S) : Ernest Ferron

It is certified that error appears in the above-identified patent and that said Letters Patent is hereby corrected as shown below:

First page, Item [56], following the 7th line insert:

--3,861,264 1/1975 Matsumoto et al.-- and following the last line insert:

-- FOREIGN PATENT DOCUMENTS 364,775 12/1922 Fed. Rep. of Germany
525,246 5/1931 Fed. Rep. of Germany--.

Col. 2, line 47, after "bow" insert --11--;

line 57, "division" should read --divisions--.

Signed and Sealed this

*Twenty-second* Day of *October 1985*

[SEAL]

*Attest:*

DONALD J. QUIGG

*Attesting Officer*

*Commissioner of Patents and Trademarks—Designate*